US005510799A

United States Patent [19]

Wishart

[11] Patent Number: 5,510,799

[45] Date of Patent: Apr. 23, 1996

[54] METHOD AND APPARATUS FOR DIGITAL SIGNAL PROCESSING

[75] Inventor: Alexander W. Wishart, Stevenage, Great Britain

[73] Assignee: MMS Space Systems Limited, Stevenage, England

[21] Appl. No.: 73,144

[22] Filed: Jun. 8, 1993

[30] Foreign Application Priority Data

Jun. 9, 1992 [GB] United Kingdom ..... 9212152
May 19, 1993 [GB] United Kingdom ..... 9310268

[51] Int. Cl.[6] ..... H01Q 3/22

[52] U.S. Cl. ..... 342/373; 342/196; 342/380; 342/81

[58] Field of Search ..... 342/196, 81, 380, 342/383, 382

[56] References Cited

U.S. PATENT DOCUMENTS

| | | | |
|---|---|---|---|
| 4,112,430 | 9/1978 | Ladstatter | 342/368 |
| 4,837,577 | 6/1989 | Peregrim et al. | 342/80 |
| 4,937,584 | 6/1990 | Gabriel et al. | 342/378 |
| 4,965,602 | 10/1990 | Kahrilas et al. . | |
| 5,043,734 | 8/1991 | Niho | 342/25 |
| 5,087,917 | 2/1992 | Fujisaka et al. . | |
| 5,293,329 | 3/1994 | Wishart et al. | 364/724.13 |
| 5,309,161 | 5/1994 | Urkowitz et al. | 342/132 |
| 5,345,439 | 9/1994 | Marston | 370/18 |

*Primary Examiner*—Thomas H. Tarcza
*Assistant Examiner*—Dao L. Phan
*Attorney, Agent, or Firm*—Cushman Darby & Cushman

[57] ABSTRACT

A digital signal processing method and apparatus for beam forming utilizes an N-element phased array antenna (1). For transmit side beam forming of an agile beam to be steered in a direction between three adjacent orthogonal beams three copies of complex envelope samples for the required beam signal are generated, separately weighted in amplitude and phase (4) and fed into an N-part inverse FFT processor (3) via three input ports (*7a*, *7b* and *7c*) which correspond to the three adjacent orthogonal beams, and inverse Fast Fourier Transformed therein into the required beam as a weighted combination of the three adjacent orthogonal beams for passage to the elements (2) of the phased array antenna (1). For receive side beam detection of an agile beam received from a direction between three adjacent orthogonal beams, baseband complex envelope samples of signals received on each of the N elements (2) of the antenna (1) are input to the DFT processor (3) and discrete transformed into N orthogonal beam signals, the three orthogonal beam signals (*5a*, *5b* and *5c*) output from the processor 3 which correspond to the three orthogonal beams are separately weighted in amplitude and phase at (4) and combined into an output signal (10) which is the baseband complex envelope of the required beam signal.

16 Claims, 2 Drawing Sheets

METHOD AND APPARATUS FOR DIGITAL SIGNAL PROCESSING

FIELD OF THE INVENTION

This invention relates to a method and apparatus for digital signal processing particularly suitable for agile (that is fully steerable) beam forming using an N-element phased array antenna.

BACKGROUND OF RELATED ART

Frequency domain digital beam forming operates on the samples baseband complex envelope of the beam signal. In conventional digital beam forming architecture, a beam in the transmit direction is generated by directing a copy of the signal sample sequence, multiplied by an element specific complex weight, to each antenna array element. To detect a beam in the received direction the baseband complex envelope samples on each array element are multiplied by element specific complex weights and the products summed on a sample by sample basis to generate the desired beam signal. With an antenna array of N-elements agile digital beam forming thus requires N-complex-complex multiplications per beam sample.

In a known variation of such conventional architecture, the set of orthogonal beams defined by the antenna array geometry is generated simultaneously by Discrete Fourier Transform (DFT) across the array element samples. The DFT is implemented using an appropriate Fast Fourier Transform (FFT. This reduces the number of multiplications per beam sample to the order of $\log_2 N$.

Such conventional techniques for frequency domain digital beam forming are described in "Multi Dimensional Digital Signal Processing" by Dan E. Dudgeon and Russel M Mersereau, published by Prentice-Hall 1984.

In applications where the orthogonal beams generated by FFT beam forming are too widely spaced to give the desired density of beams over the coverage area, additional, non-orthogonal, beams may be interpolated between the orthogonal beams by extending the transform size beyond that defined by the physical array elements. This means zero extending the array in the receive direction and windowing the extended transform output in the transmit direction. However the increase in transform size, allied to the fact that only a subset of the beams thus generated are over the coverage area, severely compromises the computational efficiency of generating the beams this way, to the extend that there may be little or no computational advantage in using FFT to generate agile beams in this way.

There is thus a need to provide a generally improved digital signal processing mehtod and apparatus for beam forming using an N-element phased array antenna which substantially retains the computational efficiency of FFT beam forming to generate the N orthogonal beams and at the same time provide the ability to generate additional, fully steerable beams for significantly lower computational cost than would be required by either of the two conventional techniques hereinbefore described.

SUMMARY OF THE INVENTION

According to one aspect of the present invention there is provided a digital signal processing mehtod for beam forming using an N-=element phased array antenna, in which for transmit side beam forming of an agile beam to be steered in a direction between at least three adjacent orthogonal beams, three copies of complex envelope samples for the required beam signla are generated, separately weighted in amplitude and phase, fed into an N-point Discrete Fourier Transform (DFT) processor, via three input ports thereof which correspond to the three orthogonal beams, and inverse Fast Fourier transformed therein into the required beam as a weighted combination of the three adjacent orthogonal beams for passage to the elements of the phased array antenna, and in which for receive side beam forming of an agile beam received from a direction between at least three adjacent orthogonal beams, baseband complex envelope samples of signals received on each of the N-elements of the phased array antenna are input to the N-point DFT processor and discrete transformed into N-orthogonal beam signals, the three orthogonal beam signals output form the DFT processor which correspond to the three orthogonal beams are separately weighted in amplitude and phase and are combined into an output signal which is the baseband complex envelope of the required beam signal.

This method reduces the processing rates in Application Specific Integrated Circuit (ASIC) architecture utilizing the digital signal processing method of the present invention and this can be translated directly into savings in on-board processor mass and power requirements when the ASIC architecture is employed in a spacecraft. The agile beams are formed as suitably weighted combinations of a subset of the array's natural orthogonal beams. Whilst all the orthogonal beams could be used this reduces the savings and for a 2 dimensional hexagonal array geometry the three beams adjacent to the agile beam are used.

Preferably the N-point discrete Fourier Transform (DFT) processor utilized is a digital processor or is an analogue processor.

Conveniently for transmit side beam forming of one or more additional agile beams, three copies of complex envelope samples of each required additional beam signal are generated, separately weighted in amplitude and phase, and multiplexed onto the three input ports of the N-point DFT processor.

Conveniently the complex envelope samples for the three adjacent orthogonal beams are multiplexed directly onto appropriate input ports of the N-point DFT processor.

Preferably for receive side beam forming of one or more additional agile beams, a copy of each of the three appropriate orthogonal beam signals output form the N-point DFT processor is taken, separately weighted in amplitude and phase and combined into an output signal which is the baseband complex envelope of the required additional agile beam.

According to a further aspect of the present invention there is provided a digital signal processing apparatus for beam forming utilizing an N-element phased array antenna, which apparatus includes a discrete Fourier Transform (DFT) processor having a plurality of first ports on one side thereof connectable to individual elements of the antenna, which processor is operable as an inverse Fast Fourier Transform processor for transmit side beam forming and as a discrete Fast Fourier Transform Processor for receive side beam forming, means connected to a plurality of a second ports on the other side of the processor, for separately weighting, in amplitude and phase, three copies of complex envelope samples for a required transmit beam signal for transmit side beam forming and passing them to the at least three second ports of the processor corresponding to at least three adjacent orthogonal beams between which the required transmit beam is to be steered, or three orthogonal beam signals received from the processor, for receive side beam forming, and means for generating, in transmit side beam forming, three copies of complex envelope samples for the required beam signal and passing them to the weighting means, or for receiving in receive side beam forming, the three weighted orthogonal beam signals form the weighting means and combining them into an output signal which is the baseband complex envelope of the required beam signal.

Preferably the N-point discrete Fourier Transform (DFT) processor is a digital processor or is an analogue processor.

Conveniently the apparatus includes means for generating three copies of complex envelope samples of one or more additional beam signals, amplitude and phase weighting three copies of each additional beam signal and multiplexing three weighted copies onto the three second ports of the processor for transmit side beam forming of one or more additional beams.

Advantageously the apparatus includes means for multiplexing complex envelope samples for three adjacent orthogonal beams directly onto appropriate second ports of the processor.

Preferably the apparatus includes means for generating a copy of each of the three orthogonal beam signals output form the second ports of the processor, separately amplitude and phase weighting the copies and combining them into an output signal which is the baseband complex envelope of an additional receive side agile beam.

BRIEF DESCRIPTION OF THE DRAWINGS

For a better understanding of the present invention, and to show how the same may be carried into effect, reference will now be made, by way of example, to the accompanying drawings in which.

DESCRIPTION OF PREFERRED EMBODIMENTS

Figure 1:
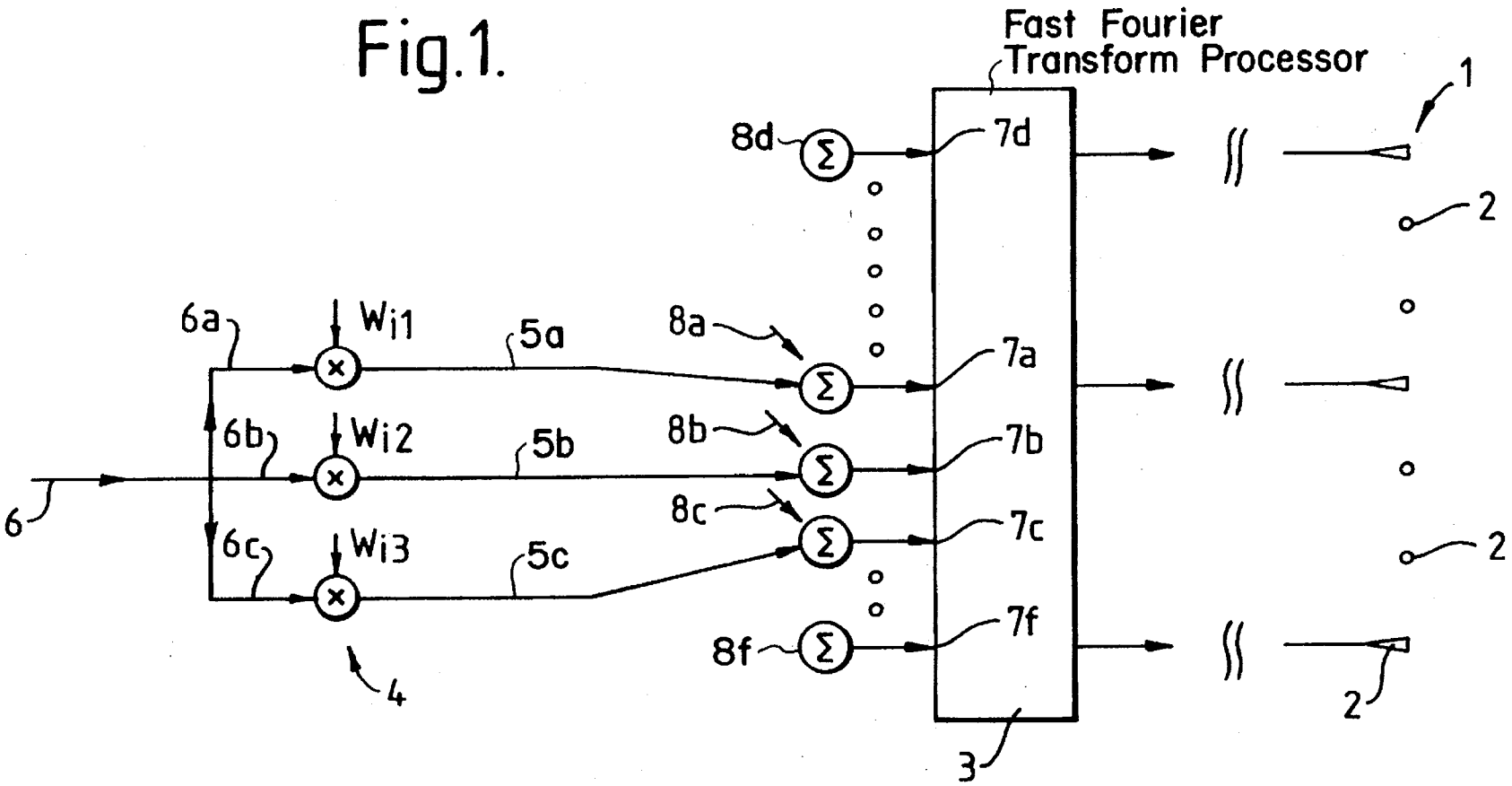
FIG. 1 is a schematic diagram of a digital signal processing apparatus according to a first embodiment of the present invention for beam forming in a transmit direction.
Figure 2:
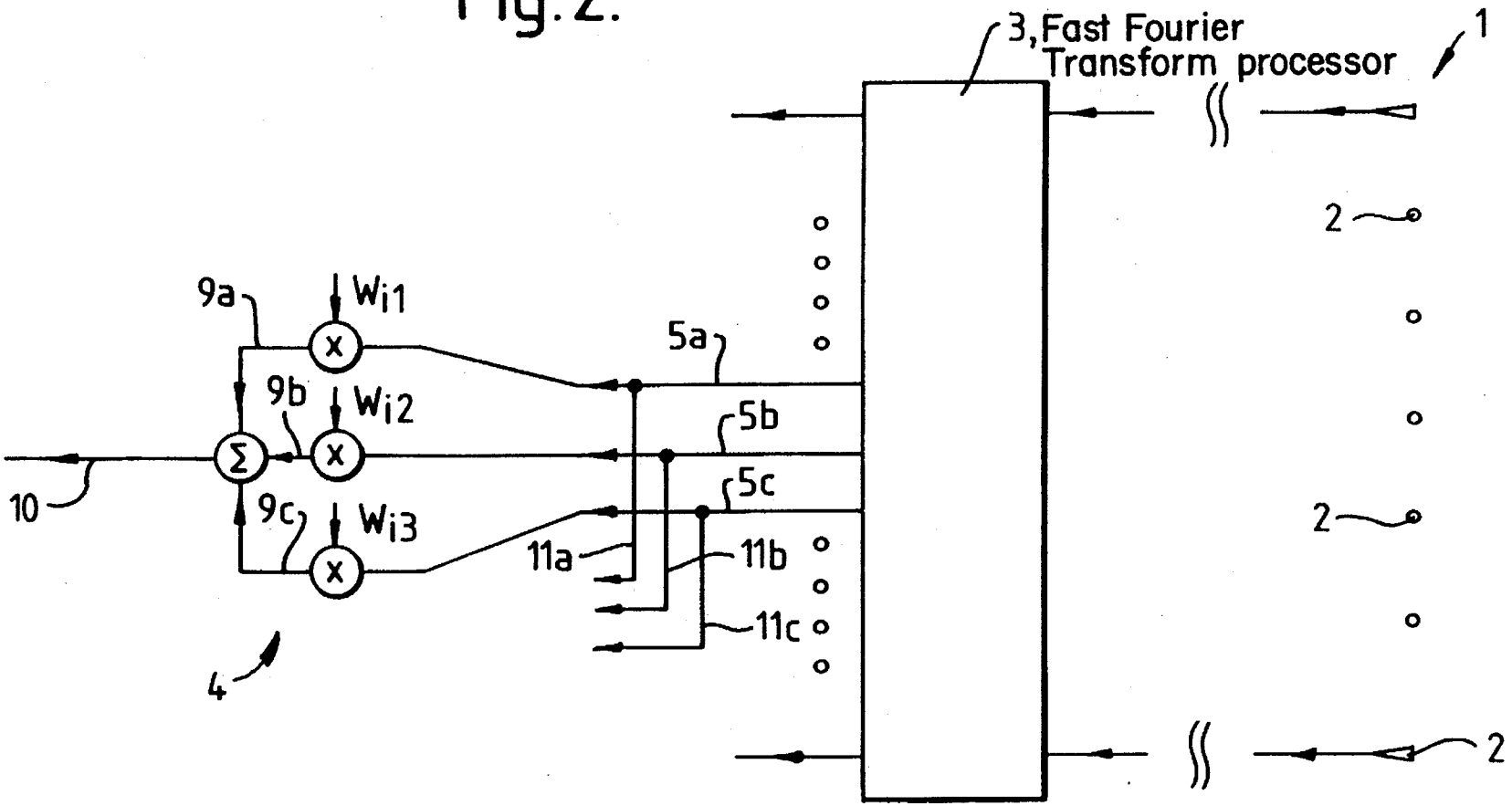
FIG. 2 is a schematic diagram similar to that of FIG. 1 of a digital signal processing apparatus of the present invention for beam forming in the receive direction.

A digital signal processing method for beam forming according to the present invention utilizes an N-element phased array antenna 1 which may be either direct or imaging. In the examples of the invention illustrated in FIGS. 1 and 2 the geometry of the array 1 is assumed to be two-dimensional with elements 2 arranged on a hexagonal lattice. The apparatus of the invention includes a Fast Fourier Transform processor 3 and signal weighting means generally indicated at 4. This FFT processor 3 may be a digital processor as illustrated in FIGS. 1 and 2 or may be an analogue processor to provide a hybrid apparatus. As previously stated FIG. 1 illustrates digital signal processing architecture for transmit side beam forming and FIG. 2 illustrates digital signal processing architecture for the receive side beam forming.

In FIG. 1 is shown the architecture for generating the i'th agile beam which is to be formed from a weighted combination of at least three adjacent signal 5*a*, 5*b* and 5*c*. Complex envelope samples 6 for the required agile beam signal are input to a beam specific first stage of the apparatus, which includes the signal weighting means 4, in which means are provided for generating three copies (6*a*, 6*b* and 6*c*) of the sample signal 6 and passing them to the signal weighting means 4 where each copy of the signal 6*a*, 6*b*, 6*c* is separately weighted in both amplitude and phase by the weights $W_{ij}$ where j equals 1, 2 or 3. The weighted samples 6*a*, 6*b* and 6*c* are fed into three input ports 7*a*, 7*b* and 7*c* of a plurality of first ports of the processor 3, which ports 7*a*, 7*b* and 7*c* correspond to the three adjacent orthogonal beams.

The processor 3 acts as an Inverse FFT processor in the transmit direction and generates the desired beam as a weighted combination of the three nearest orthogonal beams for passage to the elements 2 of the phased array antenna 1.

One or more additional agile beams may be generated in a similar way by producing three copies of complex envelope samples of each required additional beam signal, separately weighting them in amplitude and phase and multiplexing the outputs form all the agile beams onto the input ports 7*a* to 7*f* at summers 8*a* to 8*f*. For instance, complex envelope samples for an additional beam signal of three adjacent orthogonal beams are multiplexed directly onto the appropriate input ports 7*a*, 7*d* and 7*f* of the processor 3 bypassing the signal weighing means 4 and the beam specific first stage.

By using the method and apparatus of the present invention the processing for the agile beam is therefore made up of only three complex-complex multiplications which is a considerable reduction of the number of multiplications required per beam sample as compared with conventional digital beam forming techniques. By utilizing only three multiplications, only part of the capacity of the processor 3 is required which further reduces the processing cost as the processor 3 can be shared amongst all the beams.

The agile beams generated according to the present invention are not exact replicas of the orthogonal beams and in particular have a reduced peak directivity. However in most applications of the digital signal processing mehtod of the present invention this loss in directivity is greatly outweighed by the savings in on-board processor mass and power making the mehtod and apparatus of the invention particularly useful for spacecraft applications. Whilst it is possible to make the agile beams exact replicas of the orthogonal beams by appropriately combining all N orthogonal beams this would require N multiplications beams plus the use of the shared processor 3 and would thus have no advantage over conventional beam forming architectures.

Optionally the FFT can be zero extended to generate interpolated beams which can be included in the beam weighting sum to improve the quality of the resultant agile beam.

FIG. 2 of the accompanying drawings shows apparatus of the present invention for beam forming in the receive direction. For receive side beam forming of an agile beam received from a direction between at least three adjacent orthogonal beams, that is for the i'th agile beam, baseband complex envelope samples of the signals received on each of the N elements 2 of the phased array antenna 1 are input to the N-point DFT processor 3 and discrete transformed therein into N orthogonal beam signals. The three orthogonal beam signals 5*a*, 5*b* and 5*c* output from the FFT processor, corresponding to the three orthogonal beams are separately weighted in amplitude and phase in the signal weighting means 4 in a manner similar to that of the beam forming in the transmitted direction described with reference to FIG. 1 using weights $W_{ij}$ where j equals 1, 2 or 3. The amplitude and phase weighted signals 9*a*, 9*b* and 9*c* are combined into an output signal 10 which is the baseband complex envelope of the required beam signal.

For receive side beam forming of one or more additional agile beams a copy of each of the three orthogonal beam signals 5*a*, 5*b* and 5*c* is taken as at 11*a*, 11*b* and 11*c*, separately weighted in amplitude and phase and combined into an output signla which is a baseband complex envelope of the required additional agile beam.

As in the previously described transmit side beam forming technique of the present invention, the steered beams generated in receive side beam forming according to the present invention are not exact copies of the orthogonal beams. Exact replica beams could be generated by appropriately combining all N orthogonal beams but this would result in no savings in processing time and cost over conventional techniques.

I claim:

1. A mehtod for beam forming N orthogonal beams and in addition at least one agile beam, using N-point Fourier Transform processors and an N-element phased array antenna, and for beam detecting said N orthogonal beams and said at least one agile beam, said mehtod comprising steps of:

transmit side beam forming said at least one agile beam using a first set of at least three of N orthogonal beam signals corresponding to three adjacent ones of said N orthogonal beam signals, comprising steps of:

generating a first set of at least three copies of complex envelope samples of an agile beam signal;

separately weighting, in amplitude and phase, each of said first set of at least three copies of said agile beam signal;

feeding said separately weighted copies of said agile beam signal into an N-point Fast Fourier Transform processor via at least three of N input ports thereof corresponding to said first set of at least three of said N orthogonal beam signals;

performing a Fast Fourier Transform process on said N orthogonal beam signals in said N-point Fast Fourier Transform processor so that said N orthogonal beam signals include said at least one agile beam as a weighted combination of said first set of at least three of said N orthogonal beam signals: and outputting said Fast Fourier transform processed N orthogonal beam signals including said at least one agile beam at N output ports of said first Fast Fourier Transform processor for driving said N-elements of said N-element phased array antenna:

whereby N orthogonal beams and at least one agile beam are formed using N input ports and N output ports of said N-point Fast Fourier Transform processor; and receive said beam detecting said first agile beam signal, comprising steps of:

inputting N baseband complex envelope samples of signals received respectively on said N-elements of said N-element phased array antenna to an N-point Discrete Fourier Transform processor:

discrete Fourier transforming said N baseband complex envelope samples into said N-orthogonal beam signals;

outputting said N-orthogonal beam signals at corresponding N output ports of said N-point Discrete Fourier Transform processor;

weighting separately, in amplitude and phase, a copy of each of at least three of said N orthogonal beam signals output from said N-point Discrete Fourier Transform processor for each of said at least one agile beam signal received by said N-element phased array antenna; and combining said at least three separately weighted N-orthogonal beam signals to form said at least one agile beam signal.

2. A mehtod for beam forming N orthogonal beams and in addition at least one agile beam using according to claim 1, wherein:

said N-point Fast Fourier Transform processor and said N-point Discrete Fourier Transform processor are each one selected form a group comprising a digital signal processor and an analog processor.

3. A method for beam forming N orthogonal beams and in addition at least one agile beam according to claim 1 or claim 2, wherein said steps of transmit side beam forming further comprise the steps of:

generating a second set of at least three copies of a second agile beam signal;

separately weighting, in amplitude and phase, each of said second set of at least three copies of said second agile beam signal; and summing said second set of at least three copies of said second agile beam signal onto corresponding at least three input ports of said N-point Fast Fourier Transform processor.

4. A method for beam forming N orthogonal beam signals and in addition at least one agile beam signal according to claim 1, wherein:

complex envelope samples of said first set of at least three of said N orthogonal beams are multiplexed directly onto an appropriate at least three of said N input ports of said N-point Fast Fourier Transform processor.

5. A mehtod for beam forming N orthogonal beam signals and in addition at least one agile beam signal according to claim 1, wherein said steps of receive side beam detecting comprise the further step of:

generating a copy of each of said first set of at least three of said N orthogonal beam signals output from said N-point Discrete Fourier Transform processor before said step of weighting separately.

6. A digital signal processing apparatus for transmit side beam forming N orthogonal beams and in addition an agile beam, using an N-point Fourier Transform and an N-element phased array antenna, said apparatus comprising:

means for separately weighting, in amplitude and phase, each of at least three copies of complex envelope samples of at least three of N orthogonal beam signals corresponding to adjacent ones of said N orthogonal beams between which said agile beam is to be steered; and an N-point Fast Fourier Transform processor having a plurality N of input ports connected respectively to N orthogonal beam signals, and having a plurality N of output ports connectable to respective N-elements of said N-element phased array antenna, said at least three copies of said complex envelope samples being transformed by said N-point Fast Fourier Transform processor into Fast Fourier Transformed samples which are output from respective ones of said plurality N of output ports of said N-point Fast Fourier Transform processor.

7. A digital signal processing apparatus for transmit side beam forming N orthogonal beams and in addition an agile beam according to claim 6, wherein:

said N-point Fast Fourier Transform processor is one selected from a group comprising a digital signal processor and an analog processor.

8. A digital signal processing apparatus for transmit side beam forming N orthogonal beams and in addition an agile beam according to claim 7, further comprising:

means for generating said at least three copies of said complex envelope samples; and means for summing said at least three separately weighted copies of said complex envelope samples onto corresponding three of said plurality N of input ports of said N-point Fast Fourier Transform processor.

9. A digital signal processing apparatus for transmit side beam forming N orthogonal beams and in addition an agile beam according to claim 6, further comprising means for summing said at leas three separately weighted copies of said complex envelope samples corresponding to said adjacent ones of said N orthogonal beams onto corresponding ones of said plurality N of input ports of said N-point Fast Fourier Transform processor.

10. A digital signal processing apparatus for receive side beam detection of N orthogonal beams and in addition an agile beam, using an N-point Fourier processor and an N-element phased array antenna, comprising:

an N-point Fast Fourier Transform processor having a plurality N of input ports connected to respective N-elements of said N-element phased array antenna, said N-point Fast Fourier Transform processor Fast Fourier Transforming N orthogonal beam signals corresponding to said N orthogonal beams received by said N-element phased array antenna and outputting said Fast Fourier Transformed N orthogonal beam signals through a corresponding plurality N of output ports of said N-point Fast Fourier Transform processor;

means for separately weighting, in amplitude and phase, at least three of said Fast Fourier Transformed N orthogonal beam signals, so as to detect said agile beam signal from said at least three of said N orthogonal beam signals.

11. A digital signal processing apparatus for transmit side beam forming N orthogonal beams and in addition an agile beam according to claim 10, further comprising:

means for generating a copy of each of said at least three of said N orthogonal beam signals output from said plurality N of output ports of said N-point Fast Fourier Transform processor; and means for combining said separately weighted copies of each of said at least three of said N orthogonal beam signals into a baseband complex envelope of said agile beam.

12. A digital signal processing apparatus for receive side beam detection of N orthogonal beams and in addition an agile beam according to claim 10, wherein:

said N-point Fast Fourier Transform processor is one selected from a group comprising a digital signal processor and an analog processor.

13. A digital signal processing apparatus for receive side beam detection of N orthogonal beams and in addition an agile beam according to claim 10 or claim 12, further comprising:

means for generating a copy of each of sad at least three adjacent ones of said N orthogonal beam signals; and means for summing said separately weighted at least three of said Fast Fourier Transformed N orthogonal beam signals into a single output signal forming said agile beam signal.

14. A digital signal processing apparatus for receive side beam detection of N orthogonal beams and in addition an agile beam according to claim 10, further comprising:

means for summing said separately weighted at least three of said Fast Fourier Transformed N orthogonal beam signals into a signal output signal forming said agile beam signal.

15. A method for transmit side beam forming N orthogonal beams and in addition at least one agile beam signal, using an N-point Fast Fourier Transform processor and an N-element phased array antenna, comprising steps of:

generating a first set of at least three copies of said agile beam signal;

separately weighting, in amplitude and phase, each of said first set of at least three copies of said agile beam signal;

feeding said separately weighted first set of at least three copies of said complex envelope samples into said N-point Fast Fourier Transform processor, via at least three input ports thereof corresponding to said first set of at least three adjacent ones of said N orthogonal beam signals;

performing a Fast Fourier Transform process on complex envelope samples of said N orthogonal beam signals; and outputting said Fast Fourier transform processed and separately weighted copies of said complex envelope samples at N output ports of said Fast Fourier Transform processor for driving respective ones of said N elements of said N-element phased array antenna;

whereby said at least one agile beam and said N orthogonal beams are formed.

16. A method for receive side beam detection of N orthogonal beams and in addition at least one agile beam, using an N-point Fourier Transform processor and an N-element phased array antenna, comprising steps of:

inputting N baseband complex envelope samples of signals received respectively on said N-elements of said N-element phased array antenna to an N-point Discrete Fourier Transform processor;

discrete Fourier transforming said N baseband complex envelope samples into said N-orthogonal beam signals;

outputting said N-orthogonal beams signals at corresponding N output ports of said N-point Discrete Fourier Transform processor;

weighting separately, in amplitude and phase, a copy of each of at least three of said N orthogonal beam signals output from said N-point Discrete Fourier Transform processor for each of said at least one agile beam signal received by said N-element phased array antenna; and combining said at least three separately weighted N-orthogonal beam signals to form said at least one agile beam signal;

whereby said at least one agile beam and said N orthogonal beams are detected.

* * * * *